United States Patent [19]

Kirchgessner et al.

[11] 4,075,984

[45] Feb. 28, 1978

[54] GAS-LIQUID SEPARATORS

[75] Inventors: Edwin M. Kirchgessner, Peoria; Dennis G. Krohn, Pekin, both of Ill.

[73] Assignee: Caterpillar Tractor Co., Peoria, Ill.

[21] Appl. No.: 657,984

[22] Filed: Feb. 13, 1976

[51] Int. Cl.[2] ..... F01P 3/22

[52] U.S. Cl. ..... 123/41.54; 55/461; 209/144; 210/512 R

[58] Field of Search ..... 123/41.54; 55/461; 209/144; 210/512 R

[56] References Cited

U.S. PATENT DOCUMENTS

| | | | |
|---|---|---|---|
| 1,329,419 | 2/1920 | Loomis | 123/41.54 |
| 2,147,993 | 2/1939 | Scheibe | 123/41.54 |
| 2,200,620 | 5/1940 | Findley | 123/41.54 |
| 2,253,939 | 8/1941 | Scott-Paine | 123/41.54 |
| 3,028,716 | 4/1962 | Sanderson | 123/41.54 |
| 3,276,188 | 10/1966 | Carlson | 123/41.54 |
| 4,001,121 | 1/1977 | Bielefeldt | 55/461 |

*Primary Examiner*—Charles J. Myhre

*Assistant Examiner*—Daniel J. O'Connor

*Attorney, Agent, or Firm*—Phillips, Moore, Weissenberger, Lempio & Majestic

[57] ABSTRACT

A means for separating gases from coolant fluid in an engine cooling system is provided. The gas-liquid separator means utilizes a double chamber design, with the double chamber symmetrically placed on opposite sides of a flow access from the inlet to the outlet. Curved walls within the chambers of the gas-liquid separator create a centrifugal action which causes entrained gas to separate from the coolant fluid and flow to the center of curvature of the curved walls. In the first embodiment, the gas bubbles are then siphoned directly from the center of curvature to a radiator top tank of the cooling system by means of a conduit. In the second embodiment, a passage in the body of the gas-liquid separator intercommunicates the centers of curvature in each of the chambers whereby the gas bubbles are then drawn off from the passage through a conduit connected to the radiator top tank of the engine cooling system.

6 Claims, 6 Drawing Figures

GAS-LIQUID SEPARATORS

BACKGROUND OF THE INVENTION

This invention relates to gas-liquid separators for use in engine cooling systems for deaerating the coolant fluid. More particularly, this invention relates to a gas-liquid separator for separating gas from the coolant fluid by means of centrifugal action.

Internal combustion engines, such as diesel engines, are typically fluid cooled by means of a water coolant which is circulated through the engine by a coolant system. Frequently, the air from combustion gases are entrained in the coolant fluid which detracts from the cooling capability of the fluid. This causes undesired heating of the engine and components thereof.

To solve this problem, various types of engines coolant deaeration systems have been evolved. For example, U.S. Pat. Nos. 3,246,637 and 3,255,740, both to Walsh, show systems of this type. In addition, certain coolant systems employ an open radiator top tank in which coolant delivered to the top of the radiator core is contained in an open cavity that also contains a reverse volume of coolant as well as an air space. Bubbles in the fluid coolant are separated in this cavity by means of baffling.

However, with the advent of diesel engines having higher horsepowers and consequently increased coolant flows, the open top tank becomes a source of air entrainment due to the turbulence caused by the delivery of large quantities of coolant. This type of solution has not been entirely satisfactory in eliminating the problem of entrained gas in coolant fluid.

Accordingly, new solutions have been proposed. One is to entirely redesign engines to keep out combuston gases. Another is to design radiator top or expansion tanks to be more effective. However, these approaches require quite severe modifications to existing engine systems and are therefore undesirable from the standpoint of cost. A better approach has been proposed which requires merely the addition of a simple device to existing cooling systems. Such a device is a flow separator which may be inserted to a coolant fluid conduit to enable separation of gas bubbles from the coolant fluid by means of centrifugal action. Such flow separators comprise a body having an inlet and an outlet, which inlet and outlet are positioned at approximately a 90° angle to each other. Typicallly, the coolant fluid having entrained air enters the inlet and is directed around a curved internal wall of the flow separator body whereupon air bubbles are directed to the center of curvature of the wall by means of centrifugal action. A withdrawal tube or conduit is placed at the center of curvature for withdrawing air bubbles to, for example, a radiator top tank. The deaerated coolant fluid then passes out through the outlet.

One problem with the flow separator thus described is that the unit is difficult to adapt to existing engine systems, since coolant conduits are typically in straight lines and do not ordinarily accommodate 90° bends required by the described separator. The 90° bend also requires a substantial change in coolant direction which is inefficient from the standpoint of friction flow losses.

SUMMARY AND OBJECTS OF THE INVENTION

It is therefore the primary object of this invention to provide an improved centrifugal gas-liquid separator which does not have the disadvantages of prior art flow separators.

It is a further object of this invention to provide such a gas-liquid separator which may be easily inserted in existing coolant system lines and provides a straight line flow path.

It is a further object of this invention to provide such a gas-liquid separator that includes a pair of symmetrically placed chambers in a body for increased deaeration capability.

The invention takes the form of a gas-liquid separator including a body having an inlet and an outlet oriented in a straight line and a pair of chambers symmetrically arranged on opposite sides of the inlet/outlet line. The chambers have curved walls defining a center of curvature and a curved flow path for coolant fluid entering the chamber from the inlet and exiting through the outlet. Entrained gas is directed away from the curved walls by centrifugal action towards the centers of curvature of the walls. A vent is included for venting the entrained gas to, e.g. a radiator top tank in an alternate embodiment, and a passage is contained within the body intercommunicating the centers of curvature. An outlet in the passage permits the removal of entrained gas to a radiator top tank by means of a conduit connected thereto.

Other objects and advantages of this invention will become more readily apparent from a review of the following specification and drawings.

DETAILED DESCRIPTION

Figure 1:
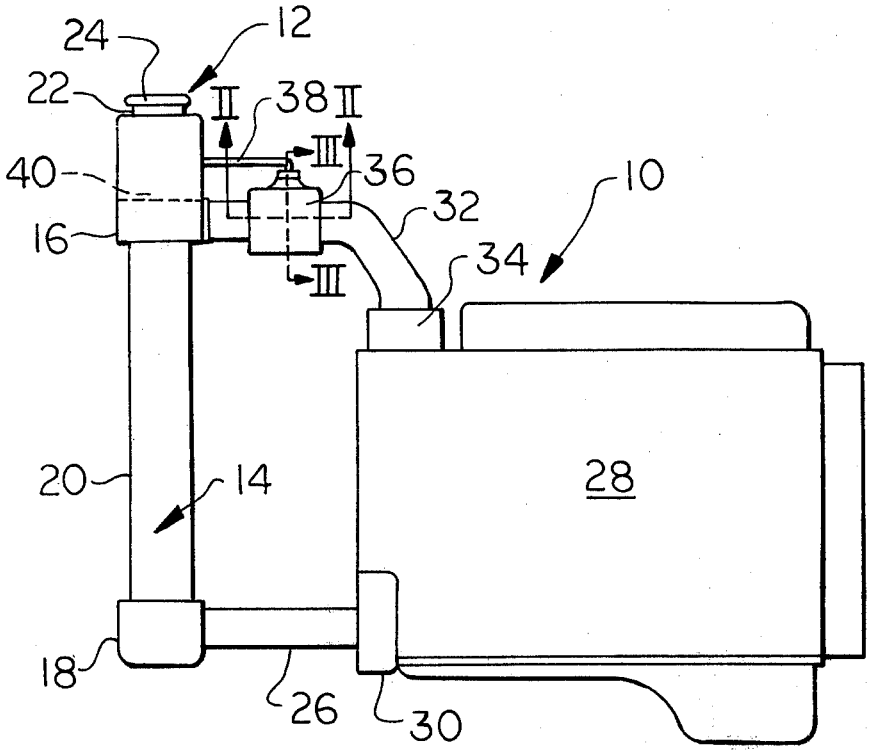
FIG. 1 shows a side-elevation view of an engine and cooling system incorporating the instant invention.

Turning now to FIG. 1, there is shown generally at 10 an engine such as an internal combustion engine or a diesel engine. The engine includes an engine cooling system shown generally at 12. The cooling system includes a radiator generally indicated at 14 having a top or inlet tank 16 and a bottom or outlet tank 18. These two tanks are connected by means of a plurality of liquid passages in a core 20 interposed between the two tanks. The upper portion of the top tank is provided with an inlet tank 22 having a filler cap removably closing the open end thereof by conventional means.

The conduit 26 permits cooled coolant fluid to be taken from the bottom tank 18 to the engine block 28 having coolant passages therein (not shown) by means of an engine-driven pump 30 mounted on the engine block. After passing through the engine block, the now-heated coolant fluid passes to the radiator top tank 16 by means of another conduit 32 leading thereto from a thermostat housing 34 mounted to the top of the engine block.

Located in conduit 32 is a centrifugal gas-liquid separator 36 of the instant invention. The gas-liquid separator has a conduit 38 leading from the top portion thereof and intercommunicating with inlet tank 22 whereby entrained air bubbles separated by the separator may be directed to the air space at the top of top tank 16.

Figure 2:
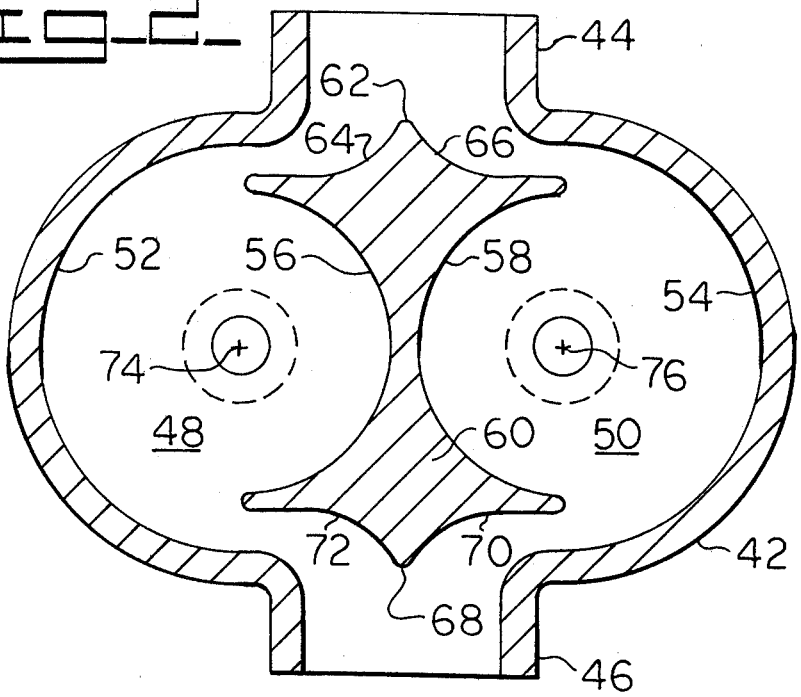
FIG. 2 shows a cross-sectional view taken along lines II—II in FIG. 1 of the gas-liquid separator of the instant invention.

Turning now to FIGS. 1 and 2, there is shown a first embodiment of the instant invention. As seen in the figures, the gas-liquid separator comprises a body 42 having a fluid inlet 44 and fluid outlet 46. The inlet and outlet define a line of flow which desirably is in a straight line for minimization of fluid flow losses. Symmetrically positioned on opposite sides of and equidistant from the line of flow are a pair of chambers 48, 50 which are generally defined by semi-circular curved walls 52, 54 of body 42 and semi-circular curved walls 56, 58 of a centrally-disposed island or divider 60.

Fluid flowing through inlet 44 is split by a wedged-shaped portion 62 of divider 60 and directed by curved walls 64, 66 in both of chambers 48, 50. It should be noted that the outlet portion of the divider is similarly shaped, having a central wedge-shaped portion 68 and curved portions 70, 72. In this manner, flow of fluid may be reversed from the outlet to the inlet in the gas-liquid separator without impairing the efficiency thereof.

Figure 3:
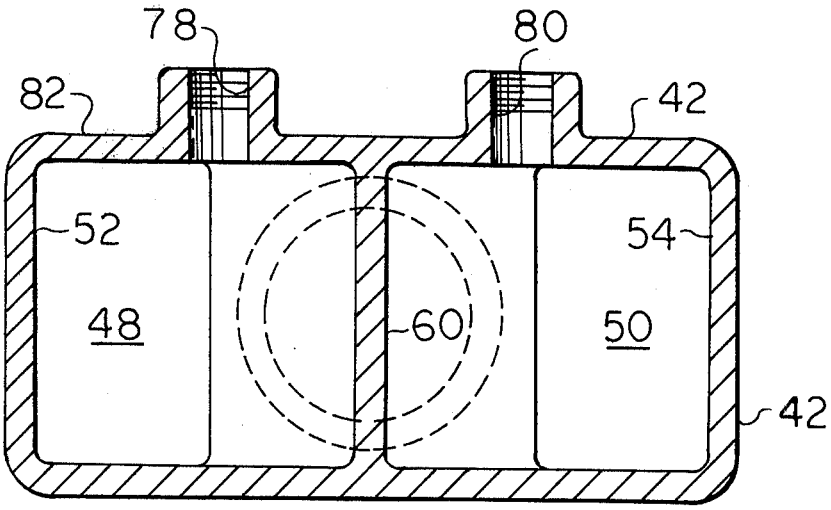
FIG. 3 shows a similar view taken along lines III—III in FIG. 1.

In operation, the coolant fluid having entrained air enters through inlet 44 and is directed by means of walls 64, 66 to flow around curved walls 52, 54, respectively. The centrifugal action generated thereby causes the gas bubbles to migrate toward the centers of curvature 74, 76, respectively which are on a radius from the curved walls. Deaerated fluid then passes out through the outlet 46 past curved walls 70, 72. As best seen in FIG. 3, vent openings 78, 80 are located at the centers of curvature in the top wall 82 of body 42. The vent openings are conveniently threaded for connection with a conduit or conduits 38, as best seen in FIG. 1.

Figure 6:
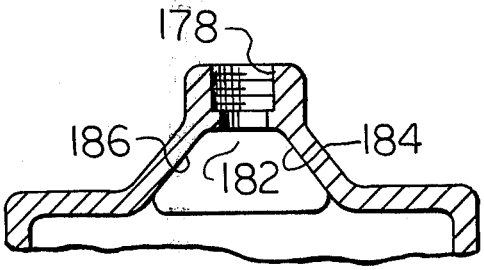
FIG. 6 shows a view taken along lines VI—VI in FIG. 5.
Figure 4:
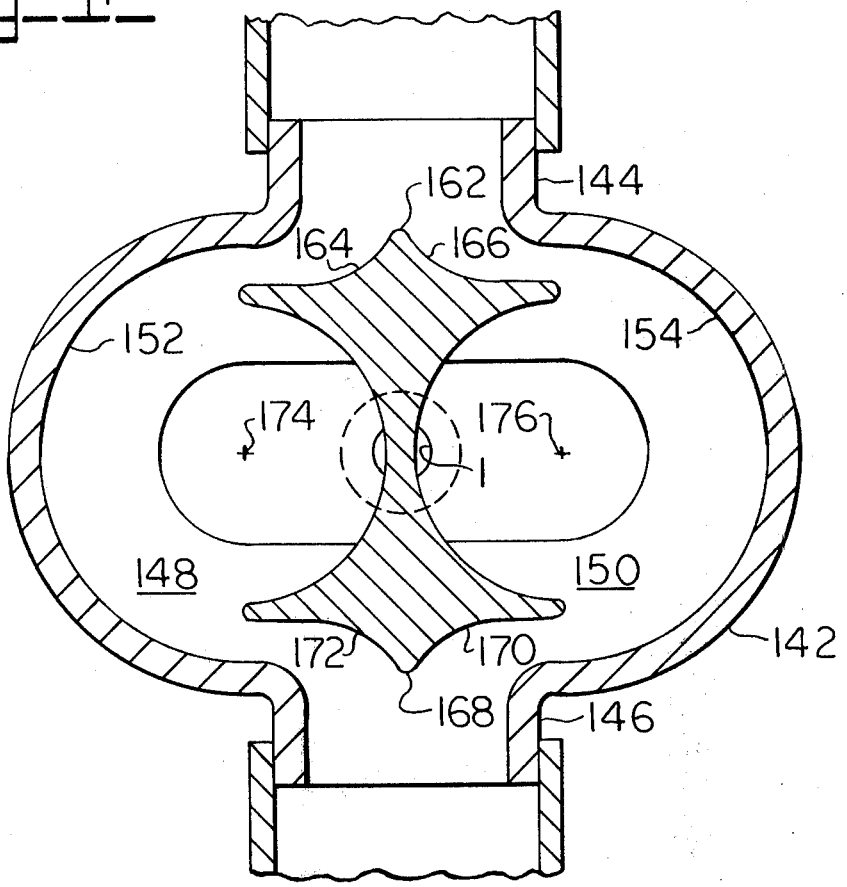
FIG. 4 shows a view similar to FIG. 2 of an alternate embodiment of the invention.
Figure 5:
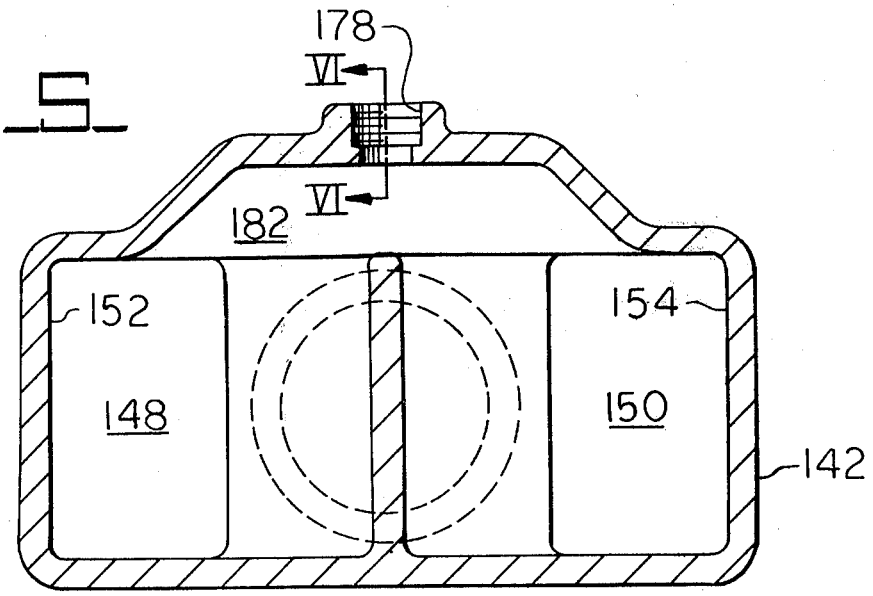
FIG. 5 shows a view similar to FIG. 3 of the alternate embodiment of the invention.

FIGS. 4 through 6 show a second embodiment of the invention which is like the first embodiment except for having a passage 182 formed in body 142, thus eliminating the necessity of two vent openings. In this case, a single vent opening 178 is provided. As best seen in FIG. 6, the passage 182 has sloping walls 184, 186 for facilitating direction of air bubbles to vent opening 178.

It is to be understood that the foregoing description is merely illustrative of a preferred embodiment of the invention and that the scope of the invention is not to be limited thereto, but is to be determined by the scope of the appended claims.

What is claimed is:

1. In an engine cooling system a liquid coolant fluid source, pump means for directing fluid from said coolant fluid source to an engine, heat exchanger means, conduit means for directing fluid from said engine to said heat exchanger means, said heat exchanger means serving to cool the fluid from said engine, conduit means further directing the fluid from said heat exchanger means to said coolant fluid source, centrifugal gas-liquid separator means in said conduit means for separating gas from the liquid of said coolant fluid by centrifugal action, and gas-liquid separator means comprising a body having an inlet and outlet, a pair of chambers within said body each in communication with said inlet and said outlet, said inlet and said outlet being aligned so as to define a straight line flow path therebetween, said chambers symmetrically placed on opposite sides of and equidistant from said straight line flow path and from said inlet and said outlet, each said chamber having semi-circular curved walls extending equal distances from said straight line flow path and defining a center of curvature on a radius from said curved walls and also defining a curved flow path for said coolant fluid entering the chamber from said inlet and exiting through said outlet whereby entrained gas in said coolant fluid is directed away from said curved walls and toward said center of curvature, said body including a divider portion therein on said straight line flow path and intermediate said chambers, and wherein said semi-circular curved walls are located on said body and on said divider portion, said divider portion further including symmetrical, generally wedge-shaped inlet and outlet portions adjacent said inlet and outlet, respectively, said wedge-shaped portions being located on said straight line flow path, whereby flow of fluid may be reversed from outlet to inlet without impairing the gas-liquid separator efficiency, and further including vent means for venting said entrained gas from said center of curvature.

2. The invention of claim 1 wherein said vent means comprises a vent opening in said body intermediate said chambers and passage means in said body intercommunicating said vent opening with said centers of curvature whereby entrained gas may be drawn off from said chambers.

3. The invention of claim 2 wherein said passage means comprises a generally elongated chamber formed in said body.

4. The invention of claim 3 wherein said generally elongated chamber is positioned over said pair of chambers whereby entrained gas rising in said pair of chambers will be collected in said elongated chamber.

5. The invention of claim 1 wherein said vent means comprises a vent opening in said body in communication with each of said centers of curvature whereby entrained gas may be drawn off from said chambers.

6. The invention of claim 1 wherein said heat exchanger means comprises a radiator having a top tank, and wherein said vent means comprises conduit means intercommunicating said body with said top tank whereby entrained gas passes from said body to said top tank.

* * * * *